US008794160B2

(12) United States Patent
Nishimura et al.

(10) Patent No.: US 8,794,160 B2
(45) Date of Patent: Aug. 5, 2014

(54) LOW-FLOOR RAILCAR BOGIE AND LOW-FLOOR RAILCAR INCLUDING THE SAME

(75) Inventors: Takehiro Nishimura, Kobe (JP); Keiichiro Kamura, Kobe (JP); Junichi Sakamoto, Kobe (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 235 days.

(21) Appl. No.: 13/320,681

(22) PCT Filed: May 26, 2010

(86) PCT No.: PCT/JP2010/003522

§ 371 (c)(1), (2), (4) Date: Nov. 23, 2011

(87) PCT Pub. No.: WO2010/137308

PCT Pub. Date: Dec. 2, 2010

(65) Prior Publication Data

US 2012/0060719 A1 Mar. 15, 2012

(30) Foreign Application Priority Data

May 26, 2009 (JP) ..... 2009-126528
May 26, 2009 (JP) ..... 2009-126529

(51) Int. Cl.

*B61D 13/00* (2006.01)
*B61D 17/10* (2006.01)
*B61F 5/00* (2006.01)
*B61F 3/08* (2006.01)

(52) U.S. Cl.

USPC ..... 105/158.2; 105/453; 105/169

(58) Field of Classification Search

USPC ..... 105/158.2, 182.1, 453, 169, 180, 167, 105/168; 295/42, 36.1, 42.1

See application file for complete search history.

(56) References Cited

U.S. PATENT DOCUMENTS 2,340,648 A * 2/1944 Daniel ..... 295/42
2,899,911 A * 8/1959 Lich ..... 105/171

(Continued)

FOREIGN PATENT DOCUMENTS

JP U-50-152082 12/1975

(Continued)

OTHER PUBLICATIONS

International Search Report issued in Application No. PCT/JP2010/003522; Dated Aug. 17, 2010.

*Primary Examiner* — Mark Le
(74) *Attorney, Agent, or Firm* — Oliff PLC

(57) ABSTRACT

A low-floor railcar bogie of the present invention includes: a bogie frame including a pair of left and right side beams and a cross beam, each of the left and right side beams including a front portion, an intermediate portion, and a rear portion in a vehicle longitudinal direction, the intermediate portion being located at a position lower than the front portion and the rear portion, the cross beam connecting the intermediate portions of the pair of side beams each other; a pair of front and rear axle beams formed separately from the bogie frame, respectively located on a front side and rear side of the cross beam, and each extending in a vehicle width direction; independent wheels rotatably supported by left and right side portions of the axle beams, respectively; primary suspensions configured to elastically couple the front and rear portions of the side beams and the left and right side portions of the axle beams; and secondary suspensions provided on upper surfaces of the front and rear portions of the side beams.

13 Claims, 10 Drawing Sheets

(56) References Cited

U.S. PATENT DOCUMENTS

| | | | | |
|---|---|---|---|---|
| 6,257,561 | B1 * | 7/2001 | Nakayama et al. | 267/64.19 |
| 6,418,859 | B1 | 7/2002 | Hentschel et al. | |
| 6,702,350 | B1 * | 3/2004 | Gorniak | 295/43 |
| 2007/0186803 | A1 | 8/2007 | Rodet et al. | |

FOREIGN PATENT DOCUMENTS

| | | | |
|---|---|---|---|
| JP | B2-2541062 | | 10/1996 |
| JP | A-2000-309268 | | 11/2000 |
| JP | A-2001-010487 | | 1/2001 |
| JP | A-2004-276730 | | 10/2004 |
| JP | A-2004-322911 | | 11/2004 |
| JP | A-2006-142987 | | 6/2006 |
| JP | A-2007-204039 | | 8/2007 |
| JP | A-2008-062680 | | 3/2008 |
| WO | WO 2008/132360 | * | 11/2008 |
| WO | WO 2009/063569 A1 | | 5/2009 |

* cited by examiner

LOW-FLOOR RAILCAR BOGIE AND LOW-FLOOR RAILCAR INCLUDING THE SAME

TECHNICAL FIELD

The present invention relates to a low-floor railcar bogie suitable for use in a low-floor LRV (Light Rail Vehicle) and to a low-floor railcar including the low-floor railcar bogie.

BACKGROUND ART

A bogie for supporting a carbody of a railcar, such as a streetcar, and allowing the railcar to run along a rail is provided under the floor of the carbody. In a common bogie, axles each extending in a vehicle width direction are respectively attached to front and rear portions of a bogie frame so as to be rotatable, and a pair of left and right wheels are attached to each of the axles. The bogie frame is equipped with, for example, air springs configured to absorb vibrations of the carbody. In the railcar, since the carbody on which passengers get is provided on the bogie, the height of a floor surface of the carbody from the ground is high. Therefore, there is a difference in height between an entrance of the carbody and the ground. In recent years, as the streetcars, there are low-floor railcars in which the entrance is provided at a low position to allow elderly people, disabled people, etc. to easily get on and off the railcar from the viewpoint of barrier free.

Here, proposed is a low-floor railcar in which the axles each connecting the left and right wheels are omitted, and the floor of the carbody is lowered by an empty space between left and right independent wheels (see PTL 1, for example). The bogie of this railcar includes: a bogie frame including a pair of left and right side beams and a transom which connects the side beams and is lower in height than the center of the wheel; axle boxes provided on vehicle-width-direction outer sides of the left and right independent wheels; primary suspensions configured to elastically couple the axle boxes to the front portions and rear portions of the side beams, respectively; and secondary suspensions configured to elastically couple front-rear-direction intermediate portions of the side beams to a bottom portion of the carbody. In accordance with the railcar using the above bogie, a carbody passenger room is equipped with a pair of left and right long seats which face each other and sandwich a center aisle located at the center in the vehicle width direction and extending in a front-rear direction, the center aisle can be adequately lowered, and a continuous low-floor portion from the entrance to the center aisle of the passenger room can be formed.

CITATION LIST

Patent Literature

PTL 1: Japanese Laid-Open Patent Application Publication No. 2006-142987

SUMMARY OF INVENTION

Technical Problem

In the low-floor railcar described in PTL 1, the legs of the passengers seated on the left and right long seats are located on the center aisle. Therefore, the width of the center aisle is limited by the legs of the passengers seated on the seats. On this account, the problems are that this is inconvenient and it is practically difficult for wheelchairs, etc. to pass through the center aisle. To solve these problems, front-rear facing seats may be adopted instead of the long seats. The front-rear facing seats are seats facing in the front-rear direction and are located on each of left and right sides of the center aisle located at the center in the vehicle width direction and extending in the front-rear direction. However, in this case, since the side beam, the independent wheels provided close to the front portion and rear portion of the side beam, and the secondary suspensions provided on an upper surface of the front-rear-direction intermediate portion of the side beam are provided on each of left and right side portions of the bogie, it is difficult to realize the low floor of portions of the carbody, the portions being located above the left and right side portions of the bogie, and the front-rear facing seats cannot be arranged efficiently.

Here, an object of the present invention is to provide a bogie capable of suitably realizing the low floor and a railcar including the bogie.

Solution to Problem

A low-floor railcar bogie of the present invention includes: a bogie frame including a pair of left and right side beams and a cross beam, each of the left and right side beams including a front portion, an intermediate portion, and a rear portion in a vehicle longitudinal direction, the intermediate portion being located at a position lower than the front portion and the rear portion, the cross beam connecting the intermediate portions of the pair of side beams each other; a pair of front and rear axle beams respectively located on a front side and rear side of the cross beam and each extending in a vehicle width direction; independent wheels rotatably supported by left and right side portions of the axle beams, respectively; primary suspensions configured to elastically couple the front and rear portions of the side beams and the left and right side portions of the axle beams; and secondary suspensions provided on upper surfaces of the front and rear portions of the side beams.

In accordance with the above configuration, the intermediate portion of the side beam is located at a position lower than the front portion and rear portion of the side beam, and the secondary suspensions are provided on the upper surfaces of the front portions and rear portions of the side beams. Therefore, the floor of a portion above the intermediate portion of the side beam in the carbody can be lowered. In addition, since the low intermediate portions are coupled to each other by the cross beam, the floor of the center aisle located at the vehicle-width-direction center of the carbody and extending in the front-rear direction can be lowered. Therefore, the present invention can provide the bogie capable of suitably realizing the low floor of the railcar. The load of the carbody is transmitted in order of the secondary suspensions, the bogie frame, the primary suspensions, the axle beams, and the wheels. However, in the present invention, since the secondary suspensions are provided on the front portions and rear portions of the side beams, a significant bending moment is not applied to the front portions and rear portions of the side beams as compared to a conventional bogie in which the secondary suspensions are arranged only at the intermediate portions of the side beams. Therefore, the requirement of the stiffness of a portion between the front portion and the intermediate portion and a portion between the rear portion and the intermediate portion in the side beam in the front-rear direction is eased. Thus, the bogie can be reduced in weight.

Moreover, a low-floor railcar of the present invention is a low-floor railcar configured to support a carbody by a bogie, wherein: the bogie includes a bogie frame including a pair of left and right side beams and a cross beam and having a concave shape in front view, each of the left and right side beams including a front portion, an intermediate portion, and a rear portion in a vehicle longitudinal direction, the intermediate portion being located at a position lower than the front portion and the rear portion, the cross beam connecting the intermediate portions of the pair of side beams each other, a pair of front and rear axle beams respectively located on a front side and rear side of the cross beam and each extending in a vehicle width direction, independent wheels rotatably supported by left and right side portions of the axle beams, respectively, primary suspensions configured to elastically couple the front and rear portions of the side beams and the left and right side portions of the axle beams, and secondary suspensions provided on upper surfaces of the front and rear portions of the side beams; and the carbody includes high-floor portions supported by the secondary suspensions from below, a first low-floor portion located at a vehicle-width-direction center between the pair of side beams and extending in a front-rear direction, and second low-floor portions respectively provided above bottom portions of the intermediate portions of the side beams.

In accordance with the above configuration, the intermediate portion of the side beam is located at a position lower than the front portion and rear portion of the side beam, and the secondary suspensions are provided on the upper surfaces of the front portions and rear portions of the side beams. Therefore, the second low-floor portions can be provided above the bottom portions of the intermediate portions of the side beams in the carbody. In addition, since the low intermediate portions are coupled to each other by the cross beam, the first low-floor portion located at a vehicle-width-direction center between a pair of side beams and extending in the front-rear direction can be provided in the carbody. Therefore, the present invention can provide the railcar capable of suitably realizing the low floor of the carbody. The load of the carbody is transmitted in order of the secondary suspensions, the bogie frame, the primary suspensions, the axle beams, and the wheels. However, in the present invention, since the secondary suspensions are provided on the front portions and rear portions of the side beams, a significant bending moment is not applied to the front portions and rear portions of the side beams as compared to a conventional bogie in which the secondary suspensions are arranged only at the intermediate portions of the side beams. Therefore, the requirement of the stiffness of a portion between the front portion and the intermediate portion and a portion between the rear portion and the intermediate portion in the side beam in the front-rear direction is eased. Thus, the bogie can be reduced in weight, and this contributes to the weight reduction of the railcar.

Advantageous Effects of Invention

In accordance with the present invention, the low floor and weight reduction of the railcar can be suitably realized.

DESCRIPTION OF EMBODIMENTS

Hereinafter, an embodiment according to the present invention will be explained in reference to the drawings.

Figure 1:
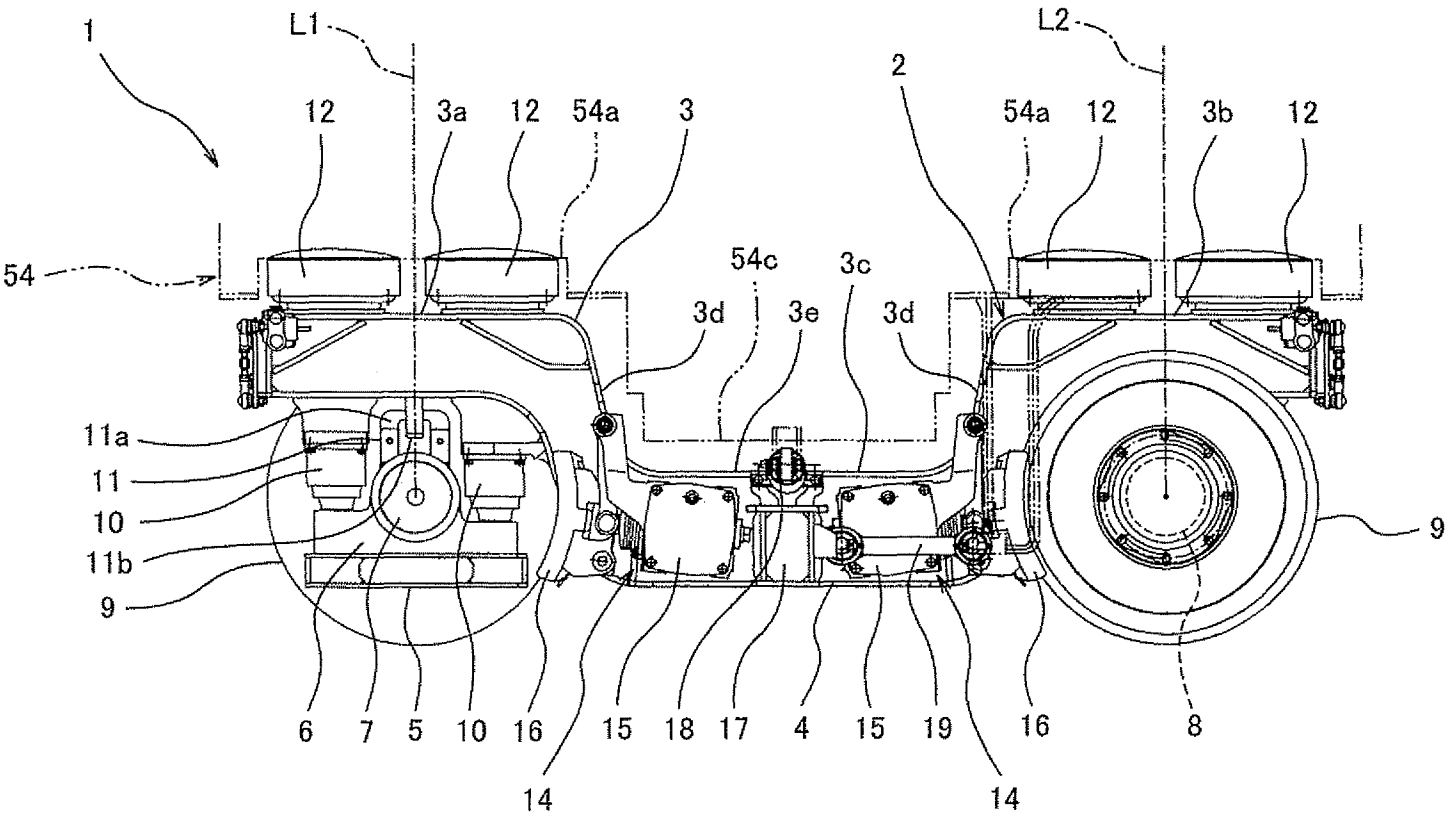
FIG. 1 is a side view showing a low-floor railcar bogie according to an embodiment of the present invention.
Figure 2:
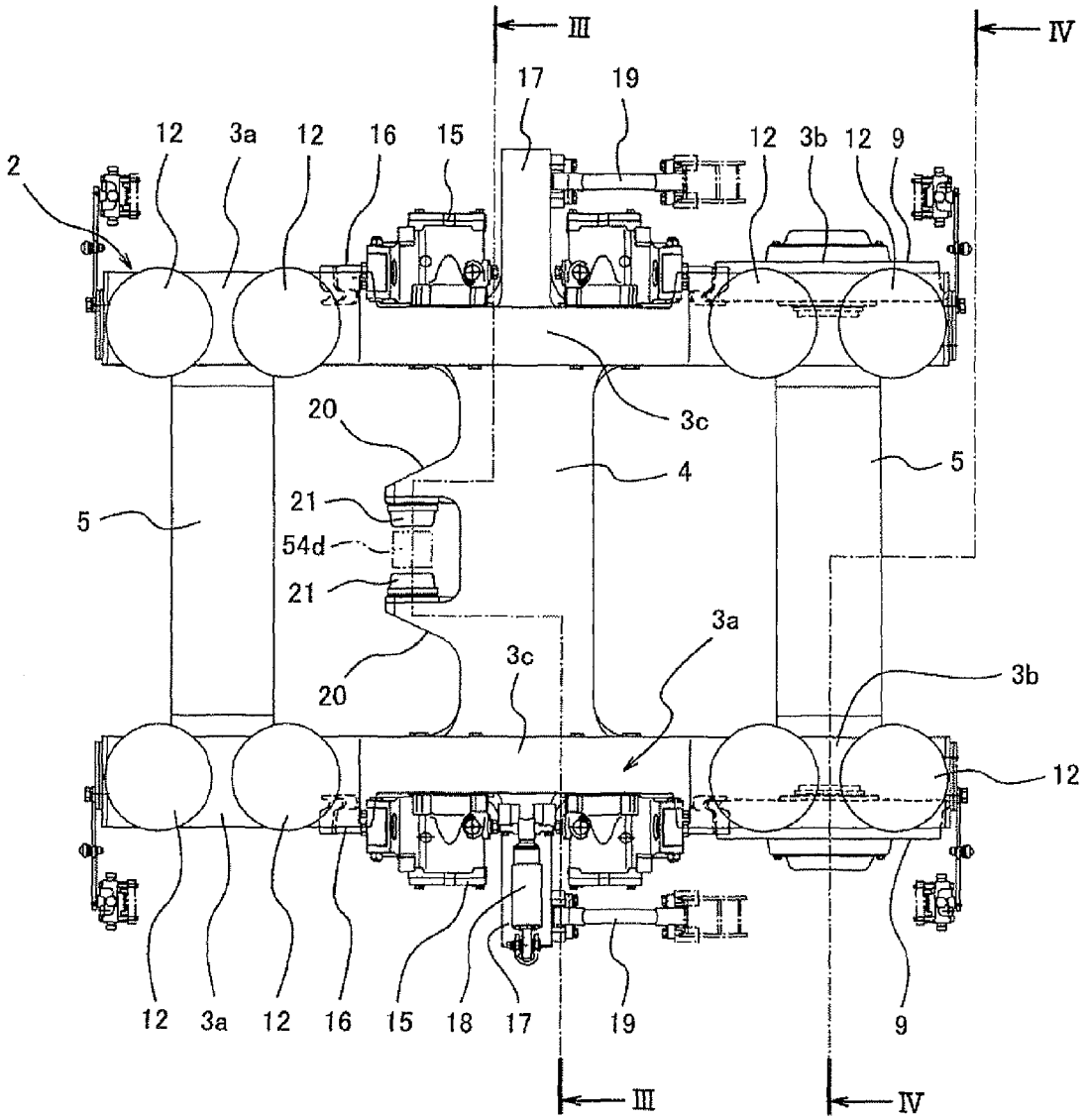
FIG. 2 is a plan view of the bogie shown in FIG. 1.
Figure 3:
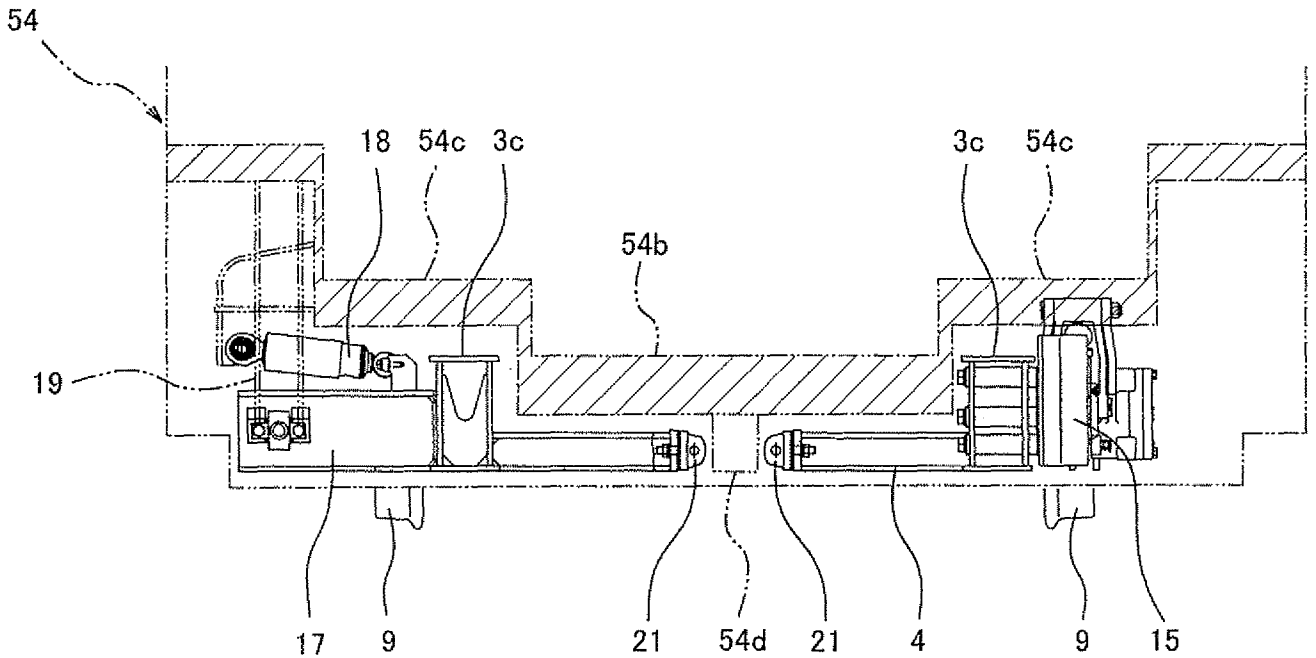
FIG. 3 is a cross-sectional view taken along line of FIG. 2.
Figure 4:
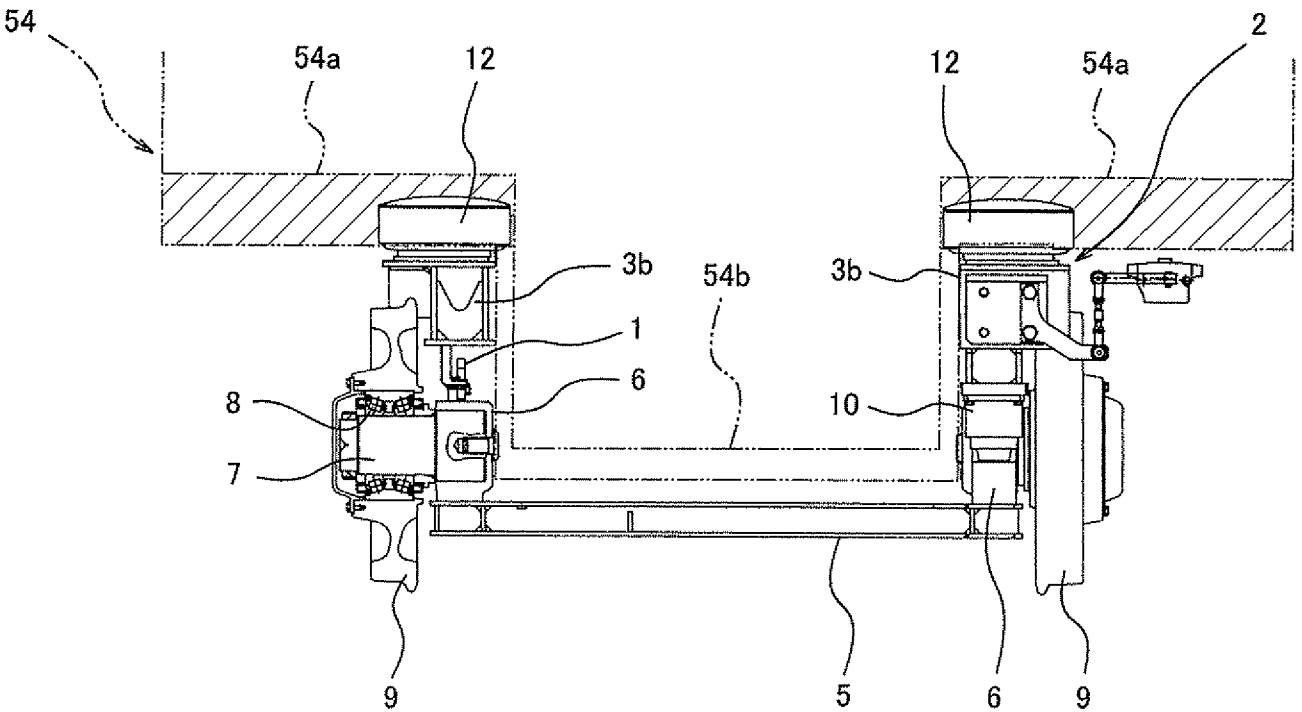
FIG. 4 is a cross-sectional view taken along line IV-IV of FIG. 2.

FIG. 1 is a side view showing a low-floor railcar bogie 1 according to the embodiment of the present invention. FIG. 2 is a plan view of the bogie 1 shown in FIG. 1. FIG. 3 is a cross-sectional view taken along line III-III of FIG. 2. FIG. 4 is a cross-sectional view taken along line IV-IV of FIG. 2. In the present specification, explanations will be made on the basis that a left side in FIG. 1 is a front side and a right side of FIG. 1 is a rear side. In FIG. 2, wheels on the left side are omitted. As shown in FIGS. 1 to 4, the bogie 1 includes a bogie frame 2 configured to support a carbody 54. The bogie frame 2 includes a pair of left and right side beams 3 each extending in a front-rear direction. Each of the side beams 3 includes a front portion 3*a* located on the front side and extending substantially horizontally in the front-rear direction, a rear portion 3*b* located on the rear side and extending substantially horizontally in the front-rear direction, and an intermediate portion 3*c* located between the front portion 3*a* and the rear portion 3*b* and formed to have a concave shape in side view. That is, the intermediate portion 3*c* is located at a position lower than the front portion 3*a* and the rear portion 3*b*.

The intermediate portion 3*c* includes a bottom portion 3*e* and side portions 3*d*. The bottom portion 3*e* is located at a position lower than the front portion 3*a* and the rear portion 3*b* and extends substantially horizontally in the front-rear direction. The side portions 3*d* extend upwardly from a front end of the bottom portion 3*e* to an end portion of the front portion 3*a* and from a rear end of the bottom portion 3*e* to an end portion of the rear portion 3*b*, respectively. The side portion 3*d* is thinner than the bottom portion 3*e* and thinner than the front portion 3*a* and the rear portion 3*b*. The bottom portions 3*e* of the intermediate portions 3*c* of the pair of side beams 3 are coupled to each other by a cross beam 4 extending substantially horizontally in a vehicle width direction. That is, the bogie frame 2 has a substantially H shape in plan view and a concave shape in front view. A vertical thickness of the cross beam 4 is smaller than that of the side beam 3, and a lower surface of the cross beam 4 is located to be substantially flush with lower surfaces of the bottom portions 3*e* of the intermediate portions 3*c* of the side beams 3.

The bogie 1 includes a pair of front and rear axle beams 5, which extend in the vehicle width direction and are respectively located on the front side of the cross beam 4 and under the front portions 3*a* of the side beams 3 and on the rear side of the cross beam 4 and under the rear portions 3*b* of the side beams 3. Each of the axle beams 5 is formed separately from the bogie frame 2, has a substantially plate shape, and provided to be substantially parallel to the cross beam 4. Independent wheels 9 are rotatably supported by left and right side portions 5*b* (see FIG. 5) of the axle beams 5, respectively. As above, although axles each for coupling the left and right wheels 9 are not provided, the axle beams 5 each serves as a beam extending between the left and right wheels 9 to maintain a constant distance between the left and right wheels 9 and supporting the wheels 9. The axle beams 5 are provided at a position lower than the rotational centers of the wheels 9. In plan view, each of the axle beams 5 is arranged to overlap an imaginary extended line of a rotation axis line of the left and right independent wheels 9. The vertical thickness of the axle beam 5 is smaller than that of the side beam 3, and lower surfaces of the axle beams 5 are located to be substantially flush with the lower surface of the cross beam 4.

The independent wheels 9 are rotatably attached to short fixed axles 7 via bearings 8, respectively. The short fixed axles 7 are individually provided. Each of the fixed axles 7 has such a length that a vehicle-width-direction inner end surface thereof does not project toward an inner side in the vehicle width direction beyond a vehicle-width-direction inner end surface of the side beam 3. Axle supporting portions 6 each for supporting the fixed axle 7 are integrally provided at the left and right side portions 5*b* (see FIG. 5) of the axle beam 5, respectively, so as to project upward. Primary suspensions 10 each configured to elastically couple the axle beam 5 and the side beam 3 are provided between upper surfaces of the axle supporting portions 6 respectively provided at the left and right side portions of the axle beam 5 located on the front side and lower surfaces of the front portions 3*a* of the pair of side beams 3. Similarly, the primary suspensions 10 each configured to elastically couple the axle beam 5 and the side beam 3 are provided between upper surfaces of the axle supporting portions 6 respectively provided at the left and right side portions of the axle beam 5 located on the rear side and lower surfaces of the rear portions 3*b* of the pair of side beams 3.

A pair of front and rear primary suspensions 10 are provided for each of the independent wheels 9. That is, the bogie 1 includes eight primary suspensions 10. In side view, the pair of front and rear primary suspensions 10 are arranged to sandwich an imaginary vertical line L1 or L2 passing through the rotational center of the independent wheel 9. Specifically, the pair of front and rear primary suspensions 10 are arranged symmetrically with respect to the imaginary vertical line L1 or L2 in the front-rear direction. The type of the primary suspension 10 is not especially limited. For example, a coil spring suspension, a plate spring suspension, a link suspension, a rubber suspension, a cylindrical guide suspension, or the like may be suitably selected.

Guide mechanisms 11 are provided between the axle supporting portions 6 on the front side and the front portions 3*a* of the side beams 3 and between the axle supporting portions 6 on the rear side and the rear portions 3*b* of the side beams 3. Each of the guide mechanisms 11 includes a guiding portion 11*a* and a guided portion 11*b* and allows the axle supporting portion 6 and the side beam 3 to be relatively displaced in the vertical direction. The guiding portion 11*a* engages with the guided portion 11*b* and projects upward from the axle supporting portion 6, and the guided portion 11*b* projects downward from the front portion 3*a* or rear portion 3*b* of the side beam 3. With this configuration, the bogie frame 2 is configured to be able to move up and down with respect to four wheels 9 connected to the bogie frame 2 via the primary suspensions 10.

Secondary suspensions 12 are provided on upper surfaces of the front portions 3*a* and rear portions 3*b* of the pair of side beams 3. A pair of front and rear secondary suspensions 12 are provided on each of the upper surfaces of the front portions 3*a* and rear portions 3*b* of the side beams 3. That is, the bogie 1 includes eight secondary suspensions 12. In the present embodiment, a diaphragm air spring is used as the secondary suspension 12. In side view, the pair of front and rear secondary suspensions 12 are arranged to sandwich the imaginary vertical line L1 or L2 passing through the rotational center of the independent wheel 9. Specifically, the pair of front and rear secondary suspensions 12 are arranged symmetrically with respect to the imaginary vertical line L1 or L2 in the front-rear direction. In plan view, the secondary suspensions 12, the front portion 3*a* (or the rear portion 3*b*) of the side beam 3, the primary suspensions 10, the axle supporting portion 6, and the left or right side portion 5*b* (see FIG. 5) of the axle beam 5 are arranged to overlap with one another. Vehicle-width-direction inner ends of the side beams 3, the primary suspensions 10, and the axle supporting portions 6 are arranged so as not to be located on the inner side in the vehicle width direction beyond the vehicle-width-direction inner ends of the secondary suspensions 12. The secondary suspensions are not provided at the intermediate portions 3*c* of the side beams 3.

In side view, wheel tread brake equipment 14 are installed on a vehicle-width-direction outer side of the bottom portion 3*e* of the intermediate portion 3*c* of the side beam 3 so as to sandwich a front-rear-direction center of the bottom portion 3*e*. Each of the wheel tread brake equipment 14 includes a brake shoe 16 facing a wheel tread 9*c* (see FIG. 6) of the wheel 9 and a drive unit 15 configured to cause the brake shoe 16 to contact the wheel tread 9*c* (see FIG. 6) of the wheel 9 and separate the brake shoe 16 from the wheel tread 9*c*. Supporting members 17 each having a substantially rectangular solid shape each projects from a front-rear direction center position of the bottom portion 3*e* of the intermediate portion 3*c* of the side beam 3 toward an outer side in the vehicle width direction. That is, the supporting member 17 is arranged at a position so as to be sandwiched between the pair of front and rear wheel tread brake equipment 14. The carbody 54 is connected to tip end portions of the supporting members 17 via traction devices 19 to allow the carbody 54 to move up and down. The cross beam 4 includes a pair of stopper portions 21 opposed to each other in the vehicle width direction. An interference piece 54*d* projecting downward from the carbody 54 is provided at a gap between the stopper portions 21. That is, when the interference piece 54*d* interferes with the stopper portions 21, the displacement of the carbody 54 with respect to the bogie 1 in the vehicle width direction is restricted. Each of dampers 18 configured to be able to expand and compress in the vehicle width direction is provided between the supporting member 17 and the carbody 54.

Figure 5:
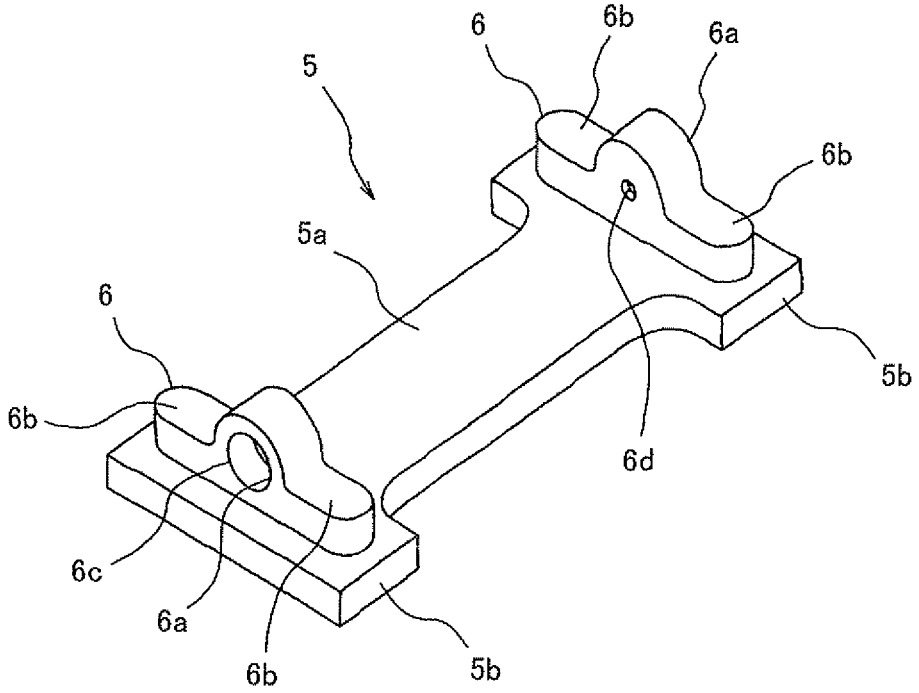
FIG. 5 is a perspective view of an axle beam shown in FIG. 4.

FIG. 5 is a perspective view of the axle beam 5 shown in FIG. 4. As shown in FIG. 5, the axle beam 5 includes a main body portion 5*a* extending in the vehicle width direction and the left and right side portions 5*b* which are continuously formed from left and right sides of the main body portion 5*a*, respectively, and each has a larger front-rear-direction width than the main body portion 5*a*. The axle supporting portions 6 are integrally formed on upper surfaces of the left and right side portions 5*b* of the axle beam 5, respectively, by welding or the like. Each of the axle supporting portions 6 includes an axle housing 6*a* and a base portion 6*b*. The axle housing 6*a* is a concave portion on which an internal space 6*c* is formed. The internal space 6*c* is open toward the outer side in the vehicle-width direction. The base portion 6*b* extends from the axle housing 6*a* in the front-rear direction and is smaller in height than the axle housing 6*a*. A bolt through hole 6*d* is formed at the center of a bottom wall (vehicle-width-direction inner wall) of the axle housing 6*a*. An upper surface of the base portion 6*b* is a substantially horizontal surface, and a lower end portion of the primary suspension 10 contacts the upper surface of the base portion 6*b*.

Figure 6:
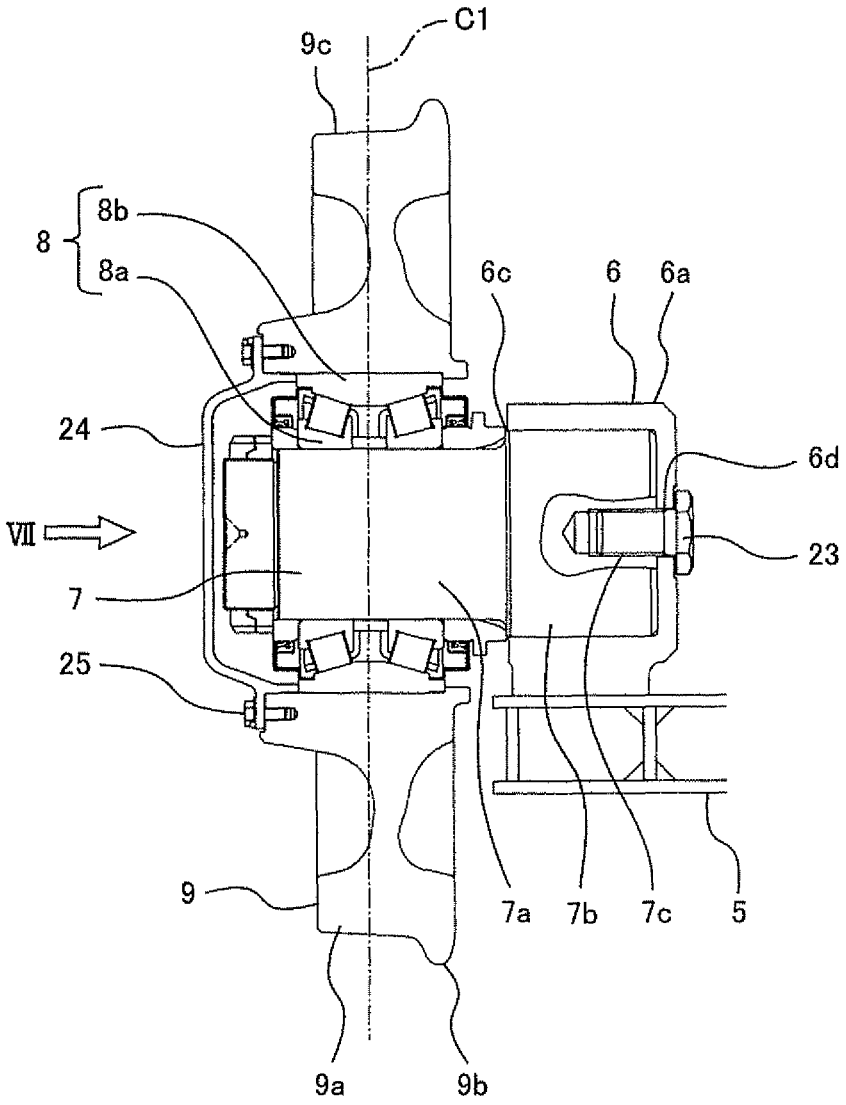
FIG. 6 is an enlarged vertical cross-sectional view of an independent wheel shown in FIG. 4 and its periphery.
Figure 7:
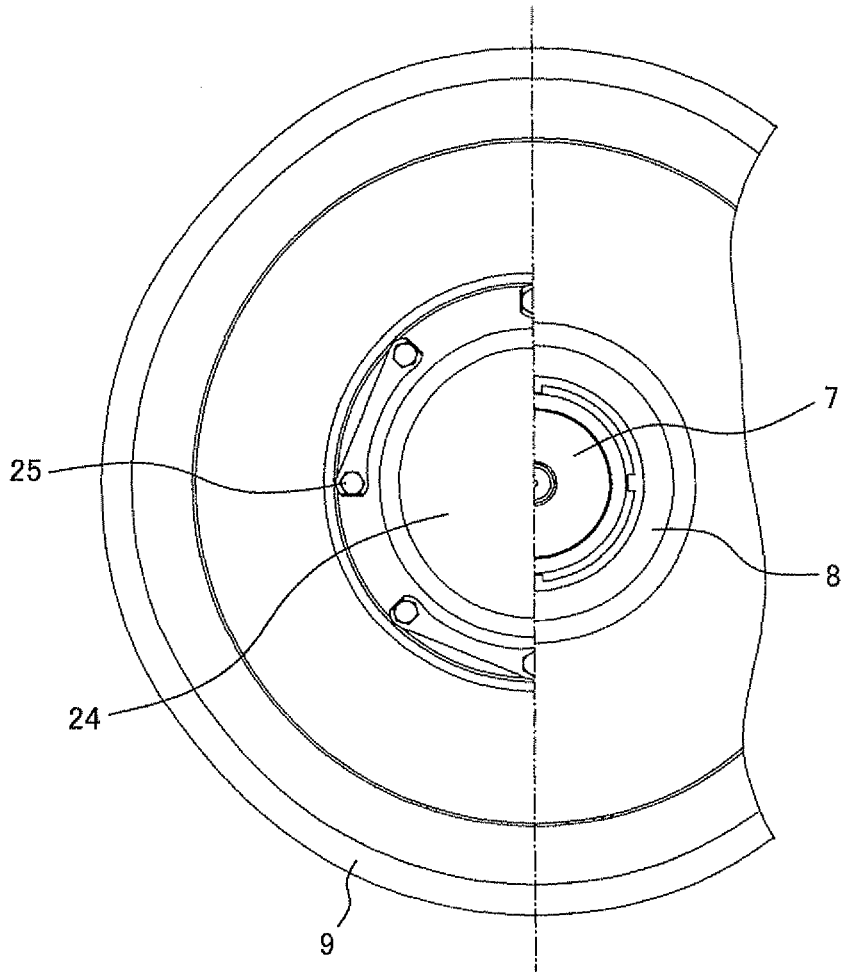
FIG. 7 is a diagram when viewed from a direction indicated by an arrow VII of FIG. 6. A left half of FIG. 7 shows a state where a cover is attached, and a right half of FIG. 7 shows a state where the cover is detached.

FIG. 6 is an enlarged vertical cross-sectional view of the independent wheel 9 shown in FIG. 4 and its periphery. FIG. 7 is a diagram when viewed from a direction indicated by an arrow VII of FIG. 6. A left half of FIG. 7 shows a state where a cover 24 is attached, and a right half of FIG. 7 shows a state where the cover 24 is detached. As shown in FIGS. 6 and 7, the fixed axle 7 includes a columnar small-diameter portion 7*a* and a columnar large-diameter portion 7*b* formed coaxially with the small-diameter portion 7*a* and continuously toward the inner side in the vehicle width direction. The large-diameter portion 7*b* of the fixed axle 7 is fitted in the axle housing 6*a* of the axle supporting portion 6 by press fitting from the outer side in the vehicle-width direction. A screw hole 7*c* is formed on a vehicle-width-direction inner end surface of the large-diameter portion 7*b* of the fixed axle 7 so as to correspond to the bolt through hole 6*d*. A bolt 23 inserted through the bolt through hole 6*d* is fastened to the screw hole 7*c*.

Each of the independent wheels 9 includes a wheel main body portion 9*a* and a flange portion 9*b*. The wheel tread 9*c* configured to contact an upper surface of a head portion of a rail is formed on an outer peripheral surface of the wheel main body portion 9*a*. The flange portion 9*b* is formed continuously on a vehicle-width-direction inner side of the wheel main body portion 9*a*. The independent wheel 9 is an annular wheel, and the bearing 8 is incorporated between an inner peripheral surface of the independent wheel 9 and an outer peripheral surface of the small-diameter portion 7*a* of the fixed axle 7. The bearing 8 includes an inner ring portion 8*a* and an outer ring portion 8*b*. The inner ring portion 8*a* is fixed to the small-diameter portion 7*a* of the fixed axle 7. The outer ring portion 8*b* is rotatable with respect to the inner ring portion 8*a* and is fixed to the inner peripheral surface of the independent wheel 9. The position of a vehicle-width-direction center C1 of the bearing 8 substantially coincides with the position of a vehicle-width-direction center C1 of the wheel tread 9*c* of the wheel 9 in the vehicle width direction. With this, the vehicle-width-direction center C1 of the bearing 8 is slightly displaced toward the outer side in the vehicle width direction from a vehicle-width-direction center of the entire wheel 9. The cover 24 for covering side portions of the fixed axle 7 and the bearing 8 is fixed on a vehicle-width-direction outer side of the wheel 9 by bolts 25. In the present embodiment, since the bearing 8 is incorporated in the wheel 9, there is no axle box.

Figure 8:
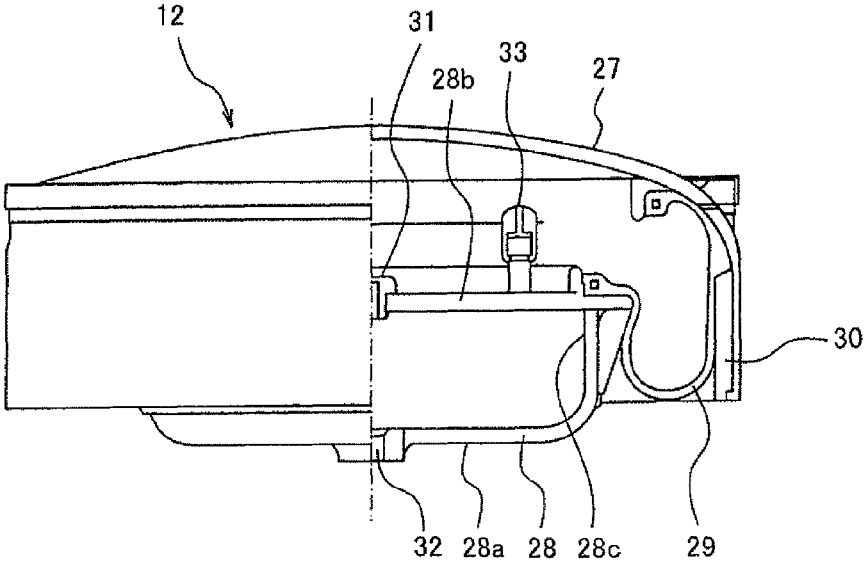
FIG. 8 is a side view of a secondary suspension shown in FIG. 1, a right half of the secondary suspension being shown as a cross section.
Figure 9:
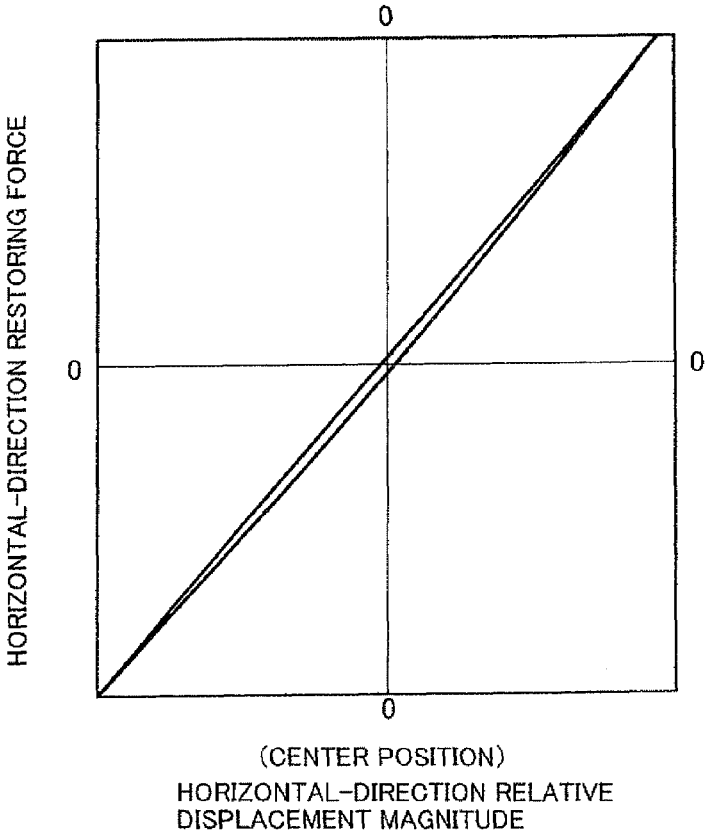
FIG. 9 is a characteristic line diagram showing a relation between a horizontal-direction relative displacement magnitude of the secondary suspension shown in FIG. 8 and a horizontal-direction restoring force of the secondary suspension.

FIG. 8 is a side view of the secondary suspension 12 shown in FIG. 1, a right half of the secondary suspension 12 being shown as a cross section. FIG. 9 is a characteristic line diagram showing a relation between a horizontal-direction relative displacement magnitude of the secondary suspension 12 shown in FIG. 8 and a horizontal-direction restoring force of the secondary suspension 12. As shown in FIG. 8, the secondary suspension 12 is a diaphragm air spring (reference sign 12 may hereinafter denote the diaphragm air spring) including an air spring main body 28, an outer cover 27, and an annular diaphragm 29. The outer cover 27 covers an upper side of the air spring main body 28 and has an inverted concave cross section whose lower end is open. The annular diaphragm 29 connects the air spring main body 28 and the outer cover 27 so as to form an internal space between the air spring main body 28 and the outer cover 27. The height of the diaphragm air spring 12 is equal to or shorter than the half of the outer diameter of the diaphragm air spring 12. The diaphragm 29 connects an upper end portion of the air spring main body 28 and an inner peripheral surface of the outer cover 27 in a state where the diaphragm 29 is curved to have a downwardly convex shape.

The air spring main body 28 includes a lower wall portion 28*a*, an upper wall portion 28*b*, and a cylindrical portion 28*c*. The upper wall portion 28*b* is provided so as to be spaced apart from the lower wall portion 28*a*. The cylindrical portion 28*c* connects a peripheral portion of the lower wall portion 28*a* and a peripheral portion of the upper wall portion 28*b*. An orifice 31 is provided at the center of the upper wall portion 28*b*, and an air induction hole 32 is provided at the center of the lower wall portion 28*a*. In FIG. 8, reference sign 33 is a stopper. As shown in FIG. 9, in accordance with the above-described diaphragm air spring 12, the outer cover 27 can be relatively displaced with respect to the air spring main body 28 in the horizontal direction, and a restoring force in the horizontal direction is generated based on this relative displacement magnitude. That is, the diaphragm air spring 12 obtains a linear property, which means that the horizontal-direction restoring force increases as the horizontal-direction relative displacement magnitude increases.

Figure 10:
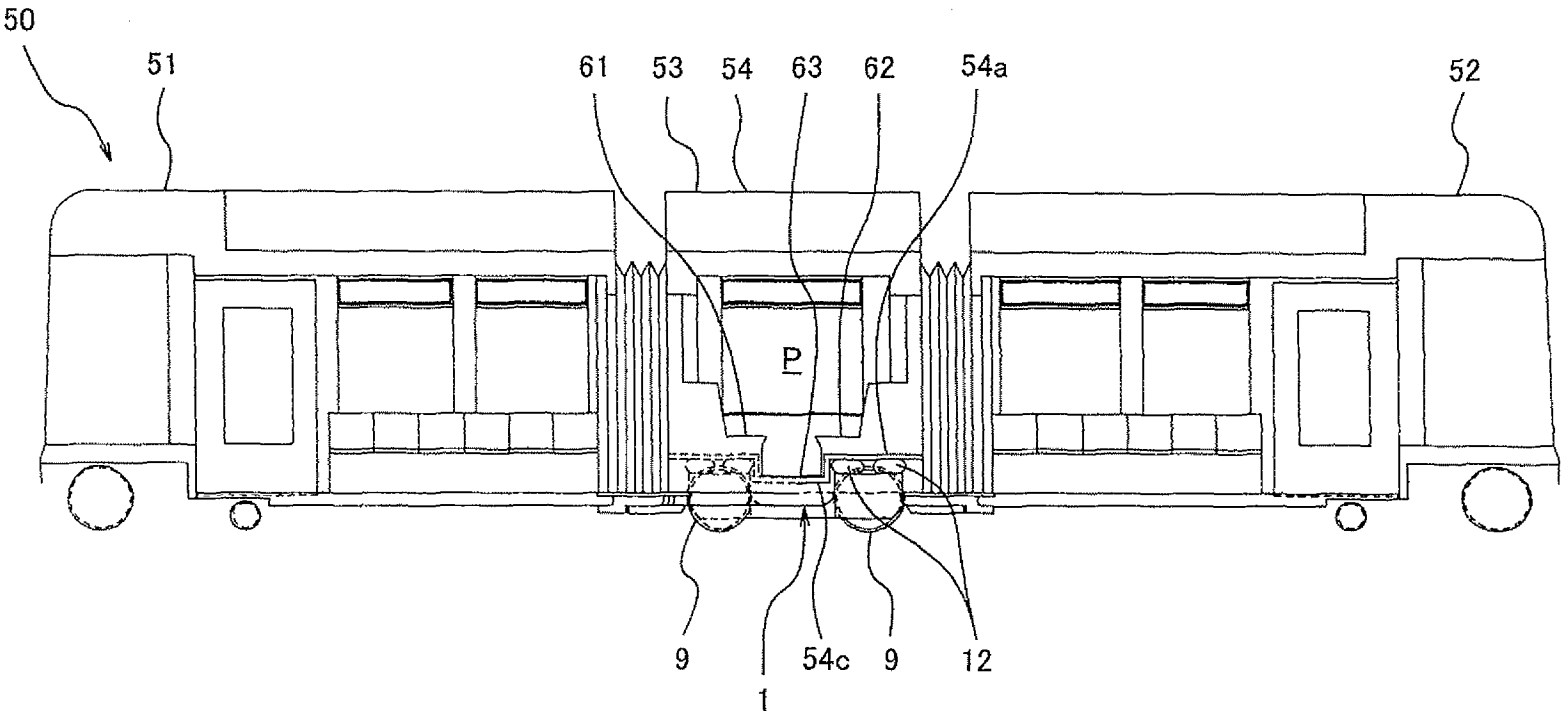
FIG. 10 is a partially transparent side view of the low-floor railcar equipped with the bogie shown in FIG. 1.
Figure 11:
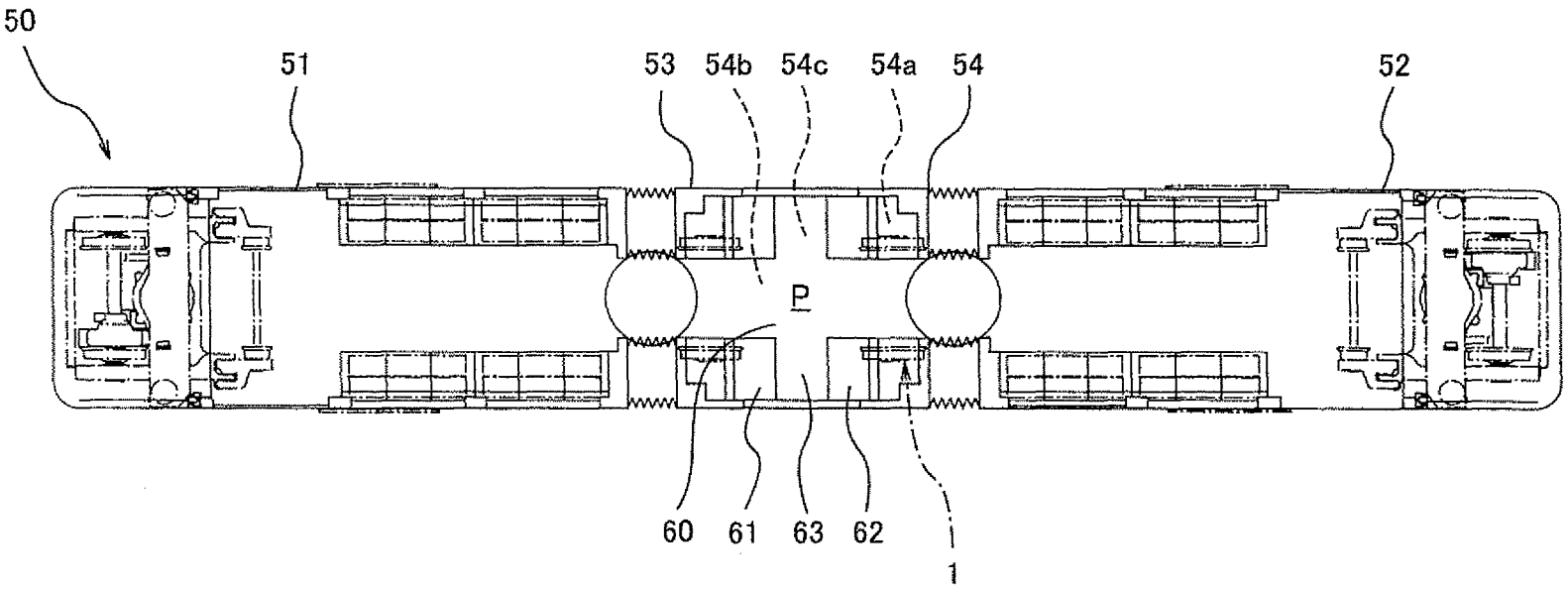
FIG. 11 is a plan view showing a passenger room in the low-floor railcar shown in FIG. 10.

FIG. 10 is a partially transparent side view of a low-floor railcar 50 equipped with the bogie 1 shown in FIG. 1. FIG. 11 is a plan view showing a passenger room P in the low-floor railcar 50 shown in FIG. 10. Hereinafter, the low-floor railcar 50 will be explained based on FIGS. 10 and 11 suitably in reference to FIGS. 1 to 4. The low-floor railcar 50 is a ultralow-floor streetcar including three cars. Cars 51 and 52 with a driver's seat are respectively coupled to the front and rear portions of a middle car 53 for the passenger room P. Each of the cars 51 and 52 as the first and third cars includes long seats arranged to face each other in the vehicle width direction, and the floor surface of the center aisle and the floor surface of a passenger entrance are low-floor surfaces.

The above-described bogie 1 is a non-driving bogie used for the middle car 53. The carbody 54 of the middle car 53 includes high-floor portions 54*a*, a first low-floor portion 54*b*, and second low-floor portions 54*c*. The high-floor portions 54*a* are supported by the secondary suspensions 12 from below. The first low-floor portion 54*b* is located at a vehicle-width-direction center between the pair of side beams 3 and extends in the front-rear direction. The second low-floor portions 54*c* are provided above the bottom portions 3*e* of the intermediate portions 3*c* of the side beams 3. Passages 60 and 63 of the passenger room P of the carbody 54 are provided on upper surfaces of the first low-floor portion 54*b* and the second low-floor portions 54*c*. Front-rear facing seats 61 and 62 facing each other in the front-rear direction are provided on upper surfaces of the high-floor portions 54*a* so as to sandwich the passage 63 provided on the second low-floor portion 54*c*. Therefore, the passengers seated on the front-rear facing seats 61 and 62 can put their legs on the passage 63. FIGS. 10 and 11 show the streetcar (LRV) which runs on the rails laid on roads. However, the present invention is not limited to this and is applicable to the other railcars.

In accordance with the above-explained configuration, since the bogie frame 2 of the bogie 1 is configured to have a concave shape in front view, the first low-floor portion 54*b* located at the vehicle-width-direction center between the pair of side beams 3 and extending in the front-rear direction can be provided in the carbody 54. In addition, since the intermediate portions 3*c* of the side beams 3 are configured to each have a concave shape in side view, and the secondary suspensions 12 are provided on the upper surfaces of the front portions 3*a* and rear portions 3*b* of the side beams 3, the second low-floor portions 54*c* can be provided above the bottom portions 3*e* of the intermediate portions 3*c* of the side beams 3 in the carbody 54. Therefore, the low floor of the carbody 54 of the railcar 50 can be realized suitably.

The load of the carbody 54 is transmitted in order of the secondary suspensions 12, the bogie frame 2, the primary suspensions 10, the axle beams 5 (axle supporting portions 6), the fixed axles 7, the bearings 8, and the wheels 9. However, since the secondary suspensions 12 are provided at the front portions 3*a* and rear portions 3*b* of the side beams 3 in the bogie 1, a significant bending moment is not applied to the front portions 3*a* and rear portions 3*b* of the side beams 3 as compared to a conventional bogie in which the secondary suspensions are arranged only at the intermediate portions of the side beams. Therefore, the requirement of the stiffness of a portion between the front portion 3*a* and the intermediate portion 3*c* and a portion between the rear portion 3*b* and the intermediate portion 3*c* in the side beam 3 is eased. As a result, for example, the side portions 3*d* of the intermediate portions 3*c* of the side beams 3 can be reduced in thickness. Thus, the bogie 1 can be reduced in weight, and this contributes to the weight reduction of the railcar 50.

A pair of front and rear air springs 12 are provided at each of the front portions 3*a* and rear portions 3*b* of the side beams 3, so that eight air springs 12 are provided in total. Therefore, while maximum pressure applied from the carbody 54 to the diaphragm air springs 12 is being maintained at a constant value or lower, the air springs 12 can be reduced in diameter. On this account, the length of projection of the air spring 12 toward the inner side in the vehicle width direction can be reduced, and the passenger room P of the carbody 54 can be widely secured. Further, since the pair of front and rear air springs 12 are arranged so as to sandwich the imaginary vertical line L1 or L2 passing through the rotational center of the independent wheel 9, the generation of unnecessary bending moment can be further suppressed.

The bearing 8 whose occupancy space is large is accommodated in the wheel 9, and the fixed axle 7 is fitted in the axle supporting portion 6 formed integrally with the axle beams 5. Therefore, a wide space can be secured on a vehicle-width-direction inner side of the wheel 9, and the low-floor area of the carbody 54 can be adequately secured.

In the above embodiment, the air spring is used as the secondary suspension 12. Instead of this, a coil spring, a rubber, a plate spring, or the like may be used. In the above embodiment, eight secondary suspensions 12 are provided. However, the above embodiment is not limited to this. For example, twelve air springs 12 may be provided by adding one more air spring 12 to each of the right front, left front, right rear, and left rear portions of the side beams 3, or four air springs may be provided by reducing one air spring from each of the right front, left front, right rear, and left rear portions of the side beams 3. In the above embodiment, the air spring 12 has a perfect circle shape in plan view. However, the air spring 12 may have an oval shape whose long axis extends in the front-rear direction in plan view. In the above embodiment, the secondary suspensions are not provided at the intermediate portions 3*c* of the side beams 3. However, suspensions each having such a height that does not affect the realization of the low floor of the carbody may be provided at the intermediate portions 3*c* of the side beams 3.

In the above embodiment, the bolt 23 for fixing the fixed axle 7 is fastened to the center of the fixed axle 7. However, the bolt 23 may be fastened eccentrically with respect to the center of the fixed axle 7. In the above embodiment, each of the internal space 6*c* of the axle housing 6*a* and the large-diameter portion 7*b* of the fixed axle 7 has a circular cross section which is orthogonal to the axial direction. However, the cross section of each of the internal space 6*c* and the large-diameter portion 7*b* may have a non-circular shape, such as a polygonal shape.

In the above embodiment, the bogie 1 is a non-driving bogie. However, the bogie 1 may be a driving bogie equipped with a driving device (for example, a motor) without disturbing the realization of the low floor of the carbody. For example, a motor or a gear device may be provided in the carbody, and driving force may be transmitted to the wheels 9 of the bogie 1 by a transmission device. Moreover, a small bilateral motor may be provided on an outer side surface of the bogie 1, and the front and rear wheels 9 may be driven by the motor via a bevel gear device. Further, a motor (in wheel motor) may be incorporated in a center portion of the wheel 9, and the wheel 9 may be driven directly.

REFERENCE SIGNS LIST

1 bogie
2 bogie frame
3 side beam
3*a* front portion
3*b* rear portion
3*c* intermediate portion
4 cross beam
5 axle beam
6 axle supporting portion
6*a* axle housing
6*d* bolt through hole
7 fixed axle
7*c* screw hole
8 bearing
9 independent wheel
9*a* wheel main body portion
9*b* flange portion
9*c* wheel tread
12 secondary suspension
23 bolt
27 outer cover
28 air spring main body
29 diaphragm
50 low-floor railcar
54 carbody
54*a* high-floor portion
54*b* first low-floor portion
54*c* second low-floor portion
60, 63 passage
61, 62 front-rear facing seat

The invention claimed is:

1. A low-floor railcar bogie comprising:

a bogie frame including a pair of left and right side beams and a cross beam, each of the left and right side beams including a front portion, an intermediate portion, and a rear portion in a vehicle longitudinal direction, the intermediate portion being located at a position lower than the front portion and the rear portion, the cross beam connecting the intermediate portions of the pair of side beams each other;

a pair of front and rear axle beams respectively located on a front side and rear side of the cross beam and each extending in a vehicle width direction;

independent wheels rotatably supported by left and right side portions of the axle beams, respectively;

primary suspensions configured to elastically couple the front and rear portions of the side beams and the left and right side portions of the axle beams; and secondary suspensions provided on upper surfaces of the front and rear portions of the side beams.

2. The low-floor railcar bogie according to claim 1, wherein the secondary suspensions, the side beams, the primary suspensions, and the axle beams are arranged so as to at least partially overlap one another in plan view.

3. The low-floor railcar bogie according to claim 1, wherein:

the secondary suspensions are provided as a pair of front and rear secondary suspensions on each of the upper surfaces of the front portions and rear portions of the side beams; and the pair of front and rear secondary suspensions are arranged so as to sandwich an imaginary vertical line passing through a rotational center of the independent wheel in side view.

4. The low-floor railcar bogie according to claim 1, wherein each of the secondary suspensions is a diaphragm air spring including: an air spring main body; an outer cover covering an upper side of the air spring main body and having an inverted concave cross section whose lower end is open; and an annular diaphragm connecting the air spring main body and the outer cover so as to form an internal space between the air spring main body and the outer cover.

5. The low-floor railcar bogie according to claim 1, wherein:

the independent wheels are rotatably attached to fixed axles via bearings, respectively, the fixed axles being provided individually; and axle supporting portions configured to respectively support the fixed axles are formed integrally with the axle beams at left and right side portions of the axle beams.

6. The low-floor railcar bogie according to claim 5, wherein:

each of the axle supporting portions includes an axle housing on which an internal space is formed, the internal space being open toward an outer side in the vehicle width direction; and the fixed axles are respectively fitted in the axle housings from the outer side in the vehicle width direction.

7. The low-floor railcar bogie according to claim 6, wherein:

each of the axle housings is a concave portion which is open toward the outer side in the vehicle width direction, and bolt through holes are respectively formed on bottom walls of the concave portions;

screw holes are respectively formed on vehicle-width-direction inner end surfaces of the fixed axles so as to respectively correspond to the bolt through holes; and bolts respectively passing through the bolt through holes are respectively fastened to the screw holes.

8. The low-floor railcar bogie according to claim 5, wherein:

the independent wheels are annular wheels; and each of the bearings is incorporated between an inner peripheral surface of the independent wheel and an outer peripheral surface of the fixed axle.

9. The low-floor railcar bogie according to claim 5, wherein:

each of the wheels includes a wheel main body portion and a flange portion, a wheel tread configured to contact an upper surface of a head portion of a rail being formed an outer peripheral surface of the wheel main body portion, the flange portion being formed on one side of the wheel main body portion in the vehicle width direction; and a vehicle-width-direction center of each of the bearings is displaced from a vehicle-width-direction center of the wheel toward the other side in the vehicle width direction such that the position of the vehicle-width-direction center of the bearing substantially coincides with the position of a vehicle-width-direction center of the wheel tread of the wheel in the vehicle width direction.

10. The low-floor railcar bogie according to claim 1, further comprising a fixed axle located such that a top surface of the fixed axle is above a low-floor portion of a carbody supported by the bogie, the low-floor portion being between the pair of side beams.

11. A low-floor railcar configured to support a carbody by a bogie, wherein:

the bogie includes a bogie frame including a pair of left and right side beams and a cross beam and having a concave shape in front view, each of the left and right side beams including a front portion, an intermediate portion, and a rear portion in a vehicle longitudinal direction, the intermediate portion being located at a position lower than the front portion and the rear portion, the cross beam connecting the intermediate portions of the pair of side beams each other, a pair of front and rear axle beams respectively located on a front side and rear side of the cross beam and each extending in a vehicle width direction, independent wheels rotatably supported by left and right side portions of the axle beams, respectively, primary suspensions configured to elastically couple the front and rear portions of the side beams and the left and right side portions of the axle beams, and secondary suspensions provided on upper surfaces of the front and rear portions of the side beams; and the carbody includes high-floor portions supported by the secondary suspensions from below, a first low-floor portion located at a vehicle-width-direction center between the pair of side beams and extending in a front-rear direction, and second low-floor portions respectively provided above bottom portions of the intermediate portions of the side beams.

12. The low-floor railcar according to claim 11, wherein:

passages of a passenger room of the carbody are provided on upper surfaces of the first low-floor portion and the second low-floor portions; and front-rear facing seats facing each other in the front-rear direction are provided on upper surfaces of the high-floor portions so as to sandwich the second low-floor portion.

13. The low-floor railcar according to claim 11, wherein the bogie further includes a fixed axle such that the first low-floor portion is lower than a top surface of the fixed axle.

* * * * *